United States Patent [19]

Billingsley et al.

[11] Patent Number: 4,690,071

[45] Date of Patent: Sep. 1, 1987

[54] TRUSS END STRUCTURE FOR STUB SILL HOPPER CARS

[75] Inventors: Robert H. Billingsley, White Oak, Pa.; Steven L. Jantzen, St. Charles, Mo.

[73] Assignee: ACF Industries, Incorporated, Earth City, Mo.

[21] Appl. No.: 828,552

[22] Filed: Jan. 29, 1986

Related U.S. Application Data

[63] Continuation of Ser. No. 558,143, Dec. 5, 1983, abandoned.

[51] Int. Cl.[4] ..... B61D 17/00

[52] U.S. Cl. ..... 105/404; 105/413; 105/247

[58] Field of Search ..... 105/396, 404, 406 A, 105/406 R, 407, 411, 413, 414, 418, 419, 420, 421, 247, 248, 244

[56] References Cited

U.S. PATENT DOCUMENTS

| | | | |
|---|---|---|---|
| 891,297 | 6/1908 | Shallenberger | 105/420 X |
| 1,547,639 | 7/1925 | Campbell | 105/420 |
| 2,092,457 | 9/1937 | Kiesel, Jr. | 105/247 |
| 3,339,499 | 9/1967 | Charles et al. | 105/248 |
| 3,509,827 | 5/1970 | Sutter | 105/248 |
| 3,577,933 | 5/1971 | Ferris et al. | 105/416 X |
| 4,362,111 | 12/1982 | Stark et al. | 105/247 |
| 4,563,957 | 1/1986 | Billingsley et al. | 105/247 X |

FOREIGN PATENT DOCUMENTS

| | | | |
|---|---|---|---|
| 635018 | 9/1936 | Fed. Rep. of Germany | 105/396 |
| 2030278 | 12/1971 | Fed. Rep. of Germany | 105/413 |
| WO82/01595 | 11/1982 | PCT Int'l Appl. | 105/248 |

*Primary Examiner*—Robert B. Reeves
*Assistant Examiner*—Glenn B. Foster
*Attorney, Agent, or Firm*—Polster, Polster and Lucchesi

[57] ABSTRACT

In a stub sill type railway hopper car the shear plate is eliminated and a truss arrangement is located in the end structure resulting in less weight.

6 Claims, 6 Drawing Figures

TRUSS END STRUCTURE FOR STUB SILL HOPPER CARS

This is a continuation of copending application Ser. No. 558,143, filed on Dec. 5, 1983 now abandoned.

BACKGROUND OF THE INVENTION

Most stub sill type rail vehicles employ a shear plate to transmit loads from a short center sill section to longitudinal members on the sides of the vehicle (side sills) for the purpose of transmitting longitudinal coupler loads through the car. A description of this shear plate is found in U.S. Pat. No. 3,339,499 hereby incorporated into the present application by this reference.

SUMMARY OF THE INVENTION

The present invention eliminates the shear plate, and a truss type system is located in the end structure.

The advantage of this truss arrangement is that a considerable weight savings is realized.

IN THE DRAWINGS

DESCRIPTION OF PREFERRED EMBODIMENTS

Figure 1:
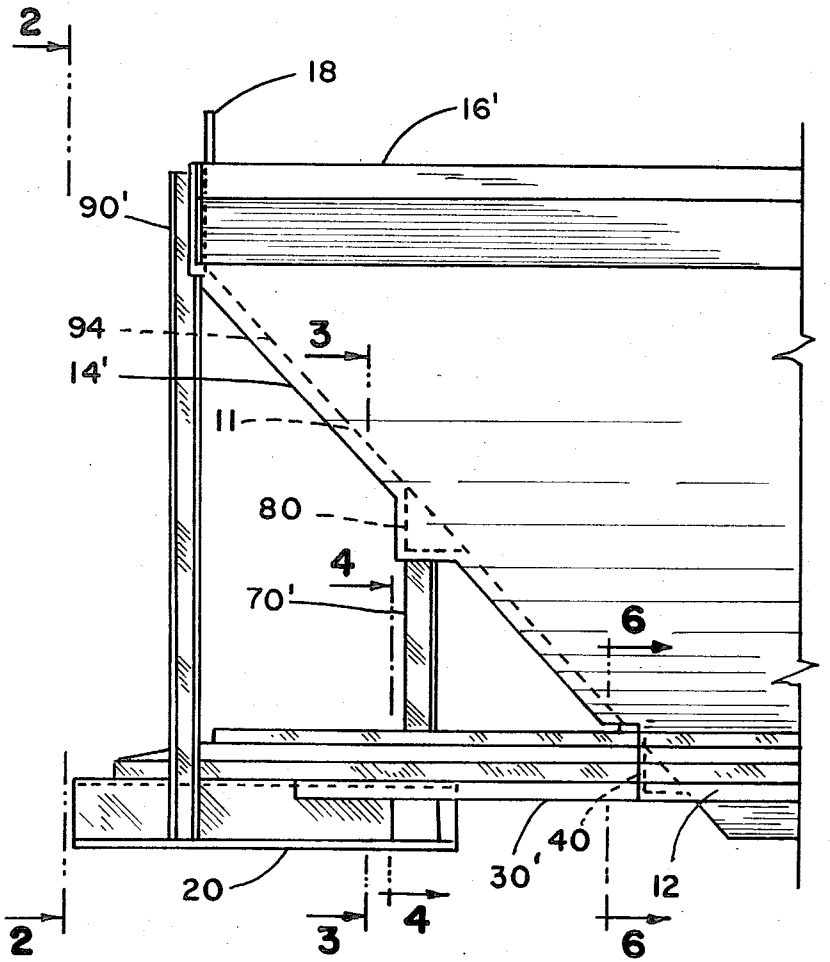
FIG. 1 is a side elevation view illustrating the present invention.
Figure 2:
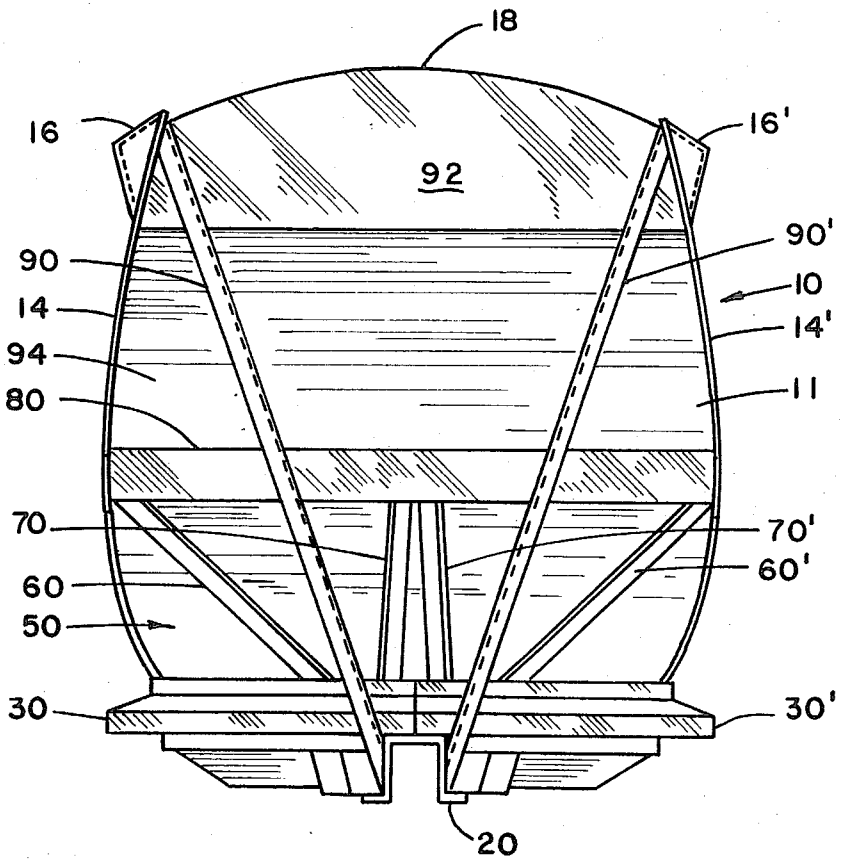
FIG. 2 is an end view looking in the direction of the arrows along the line 2—2 in FIG. 1.
Figure 4:
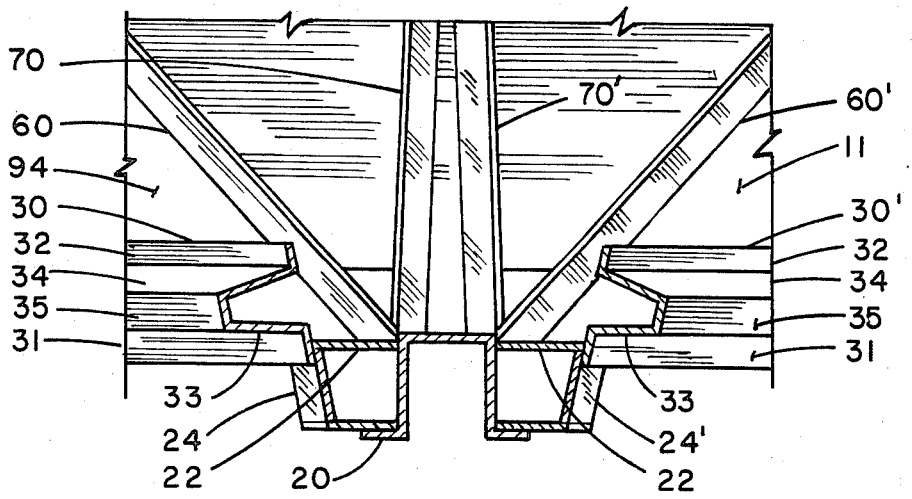
FIG. 4 is a vertical sectional view looking in the direction of the arrows along the line 4—4 in FIG. 1.
Figure 3:
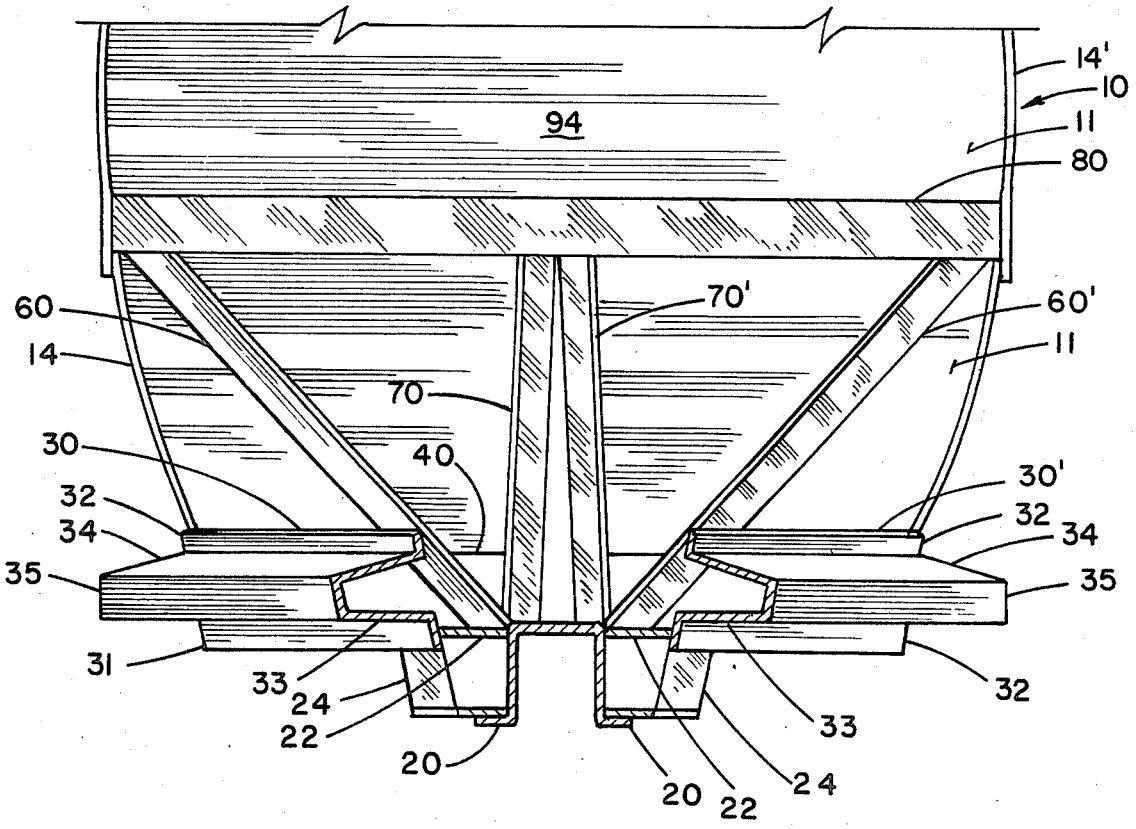
FIG. 3 is a vertical sectional view looking in the direction of the arrows along the line 3—3 in FIG. 1.

The drawings show a covered hopper car 10 having end structure 11. Side sills 12, 12' run longitudinally down the lower sides of the car. These members carry the longitudinal train forces split approximately equally on each side. Side sheets 14, 14' extend from side sills 12, 12' to top chords 16, 16'. A roof 18 connects the top chords 16, 16'.

A coupler and conventional running gear are contained in stub sill 20 located along the longitudinal centerline of the car. Side sill extensions 30, 30' at each end of the car are a continuation of side sills 12, 12' on both sides of the vehicle. Side sill extension includes flange portions 31 and 32, inclined portions 33 and 34, and vertical web portion 35.

Figure 5:
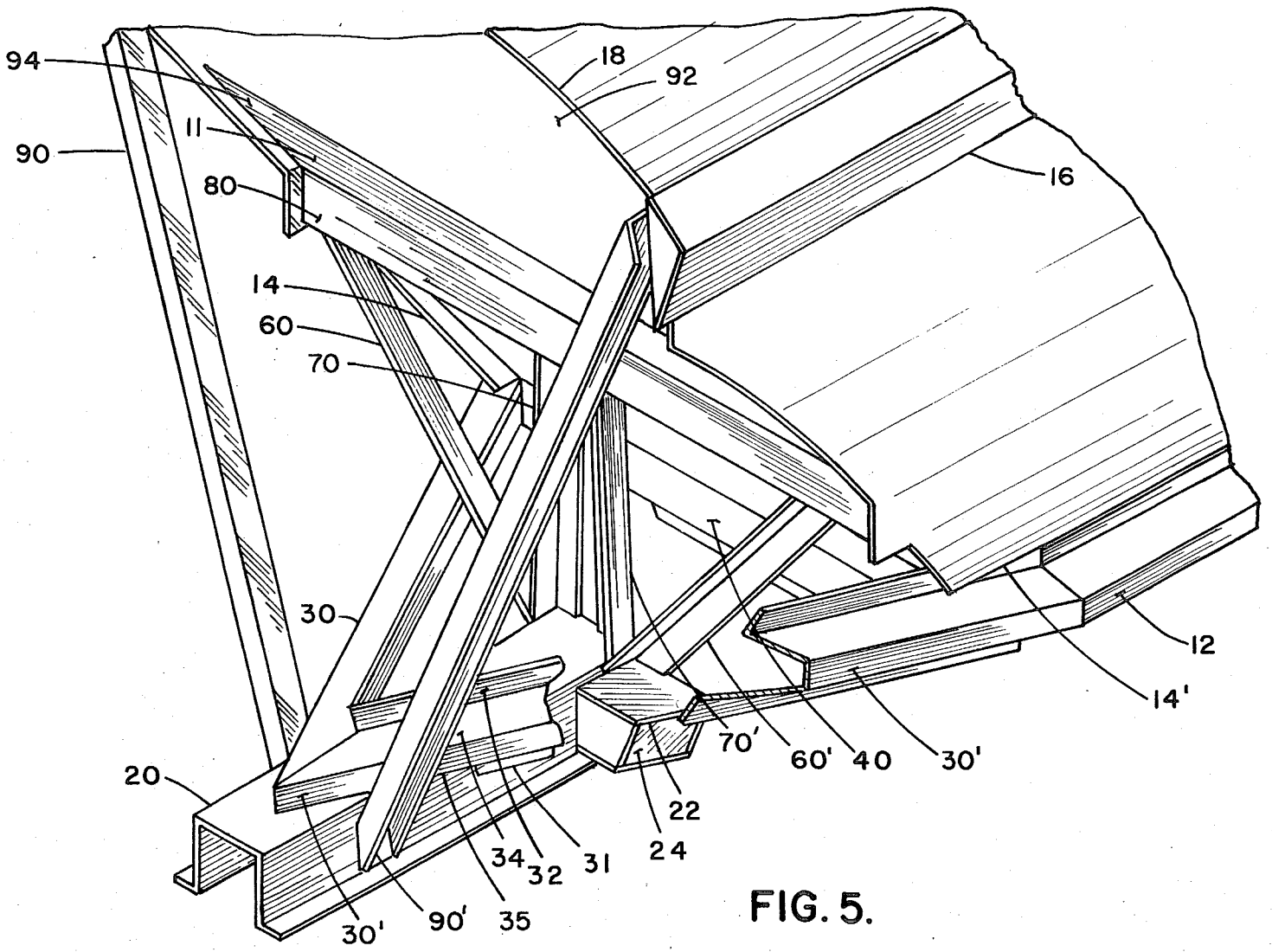
FIG. 5 is a perspective view of the truss end structure of the present invention.
Figure 6:
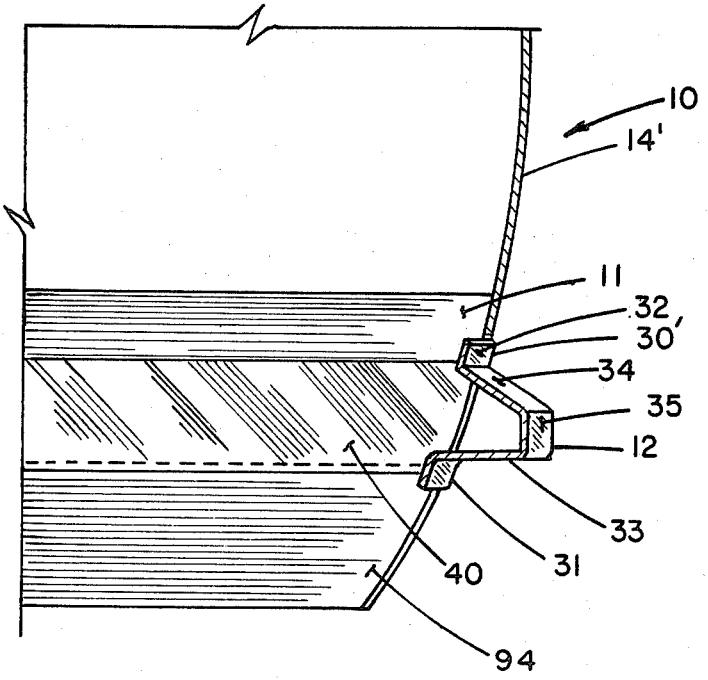
FIG. 6 is a vertical sectinal view looking in the direction of the arrows along the line 6—6 in FIG. 1.

A transverse member 40 (FIGS. 1, 5 and 6) running horizontally from side sill to side sill reacts the horizontal component of side sill extensions 30, 30'. Transverse member or strut 40, conveniently an angle, aids in the transfer of loads from stub sill 20 to the side sills 12, 12'. Extensions 30, 30' and transverse member 40 at least in part replace the conventional shear plate described in U.S. Pat. No. 3,339,499.

Vertical loads and overturning moments are taken by truss 50 composed of members 60, 60', 70, 70' and 80, and by beams 90 and 90'. All of these members are conveniently angles or channels. Member 80 is a transverse cap extending across end sheet 94. Diagonals 60 are connected to cap 80 and extend inwardly and downwardly and engage extensions 22, 22' which extend outwardly from stub sill 20. Stub sill extensions 22, 22' each include closure plates 24, 24'.

Members 70 and 70' are inclined downwardly from transverse cap 80 and end slope sheet 94, and engage extensions 62, 62'. Members 70 primarily carry vertical loading of the structure including the "side bearing load."

Vertical beams 90, 90' extend from vertical end slope sheet 92 and top chords 16, 16' to the sides of stub sill 20.

The advantages of this design is it's light weight. Estimates show a considerable weight savings of about 3,000 pounds over the shear plate construction illustrated in U.S. Pat. No. 3,339,499, owing to a more efficient structure.

Because of the significant reduction in weight, a corresponding reduction in car cost is realized.

What is claimed is:

1. In an end structure for a railway car having a car body, a stub center sill located generally along the longitudinal centerline of the car and extending axially at each end of the car body, side sills extending longitudinally along either side of the car body carrying substantially all of the longitudinal train loads from one end of the car to the other, the improvement comprising: a generally horizontal side sill extension at each side of the car extending in an inclined fashion inwardly from the end of each of said side sills to said stub center sill, said side sill extensions comprising the only horizontal load path between said stub center sill and said side sills for carrying horizontal, longitudinal loads between said side sills and said stub center sill; a means extending transversely between the ends of said side sills for carrying transverse compression and tension loads between the ends of said side sills upon horizontal, longitudinal tension and compression loads being applied to said stub center sill; and a truss structure extending upwardly between the stub center sill and car end for carrying vertical loads and overturning moments between said stub center sill and said car end.

2. An end structure according to claim 1, wherein said truss structure comprises a pair of outer, generally vertical members extending between said stub center sill and said car end.

3. An end structure according to claim 2, wherein said car body includes an end slope sheet, and wherein said truss includes a pair of inner diagonal members extending from the end slope sheet to said stub sill.

4. An end structure according to claim 1, wherein said side sill extensions engage extensions extending outwardly from said stub sill.

5. An end structure according to claim 1, wherein a pair of end diagonals are provided which extend from the car end to said stub sill.

6. A center stub sill railway car comprising a car body, a pair of spaced side sills, one for each side of said body, secured to the lower margins of said body and extending lengthwise thereof, an axially extending center stub sill at each end of said body, side sill extension means angling diagonally inwardly from the ends of each of said side sills at each end of the car toward a respective said center stub sill and being rigidly secured to their respective side sills and to said respective center stub sills for constituting the only horizontal load path between said center stub sill and said side sills thereby to carry the horizontal, longitudinal loads between said side sills and said center stub sill, strut means interposed between and secured to the ends of said side sills for transmitting horizontal, longitudinal tension or compression loads between the ends of said side sills upon applying tension or compression loads to said center stub sill, a body bolster secured to said center stub sill and extending transversely of said car, a portion of the end of said body being disposed above at least a portion of said center stub sill and said body bolster, and a plurality of members interposed between said center stub sill and said car body end and between said car body bolster and said car body end, with said members being generally within a vertical transverse plane for reinforcing said car body end relative to said center stub sill and relative to said body bolster for transmitting vertical loads between said car body end and said center stub sill and said body bolster.

* * * * *